US008164262B2

(12) United States Patent
Shiokawa et al.

(10) Patent No.: US 8,164,262 B2
(45) **Date of Patent: *Apr. 24, 2012**

(54) PLASMA DISPLAY PANEL

(75) Inventors: Akira Shiokawa, Osaka (JP); Kaname Mizokami, Kyoto (JP); Shinichiro Ishino, Osaka (JP); Koyo Sakamoto, Osaka (JP); Hiroyuki Kado, Osaka (JP); Yoshinao Ooe, Kyoto (JP); Hideji Kawarazaki, Osaka (JP); Kazuo Uetani, Osaka (JP)

(73) Assignee: Panasonic Corporation, Osaka (JP)

( * ) Notice: Subject to any disclaimer, the term of this patent is extended or adjusted under 35 U.S.C. 154(b) by 347 days.

This patent is subject to a terminal disclaimer.

(21) Appl. No.: 12/526,648

(22) PCT Filed: Feb. 26, 2009

(86) PCT No.: PCT/JP2009/000838

§ 371 (c)(1),
(2), (4) Date: Aug. 11, 2009

(87) PCT Pub. No.: WO2009/113254

PCT Pub. Date: Sep. 17, 2009

(65) Prior Publication Data

US 2011/0198993 A1 Aug. 18, 2011

(30) Foreign Application Priority Data

Mar. 10, 2008 (JP) ..... 2008-058927

(51) Int. Cl.
*H01J 17/49* (2012.01)

(52) U.S. Cl. ..... 313/587

(58) Field of Classification Search ..... 313/582–587; 315/169.4; 345/60, 30, 37, 41, 71
See application file for complete search history.

(56) References Cited

U.S. PATENT DOCUMENTS 6,249,264 B1 * 6/2001 Sano et al. ..... 345/60

(Continued)

FOREIGN PATENT DOCUMENTS

EP 1 659 605 5/2006

(Continued)

OTHER PUBLICATIONS

Supplementary European Search Report issued Jan. 19, 2011 in Application No. EP 09 70 1468.

(Continued)

*Primary Examiner* — Peter Macchiarolo
(74) *Attorney, Agent, or Firm* — Wenderoth, Lind & Ponack, L.L.P.

(57) ABSTRACT

A plasma display panel including: a front panel including a glass front substrate, a display electrode formed on the substrate, a dielectric layer formed so as to cover the display electrode, and a protective layer formed on the dielectric layer; and a rear panel disposed facing the front panel so that a discharge space is formed, the rear panel including an address electrode formed in a direction intersecting the display electrode, a plurality of longitudinal barrier ribs arranged in parallel to the address electrode and a plurality of lateral barrier ribs combined with the longitudinal barrier ribs to form mesh-shaped barrier ribs. The protective layer is formed by forming a base film on the dielectric layer and attaching a plurality of aggregated particles obtained by aggregating a plurality of crystal particles made of metal oxide to the base film so as to be discretely distributed over a surface of the base film.

3 Claims, 7 Drawing Sheets

U.S. PATENT DOCUMENTS

| | | | | |
|---|---|---|---|---|
| 7,567,036 | B2 * | 7/2009 | Hirota et al. | 313/586 |
| 7,759,868 | B2 | 7/2010 | Naoi et al. | |
| 8,053,989 | B2 * | 11/2011 | Sakamoto et al. | 313/586 |
| 2005/0206318 | A1 * | 9/2005 | Hirota et al. | 313/585 |
| 2006/0284559 | A1 | 12/2006 | Naoi et al. | |
| 2008/0290800 | A1 | 11/2008 | Saitoh et al. | |
| 2010/0102723 | A1 * | 4/2010 | Mizokami et al. | 313/587 |
| 2010/0213818 | A1 | 8/2010 | Naoi et al. | |
| 2010/0219743 | A1 | 9/2010 | Kawase et al. | |
| 2011/0298364 | A1 * | 12/2011 | Kawarazaki et al. | 313/582 |
| 2011/0316415 | A1 * | 12/2011 | Mizokami et al. | 313/587 |
| 2012/0013615 | A1 * | 1/2012 | Mizokami et al. | 345/419 |

FOREIGN PATENT DOCUMENTS

| | | |
|---|---|---|
| EP | 1 887 601 | 2/2008 |
| JP | 2006-147417 | 6/2006 |
| JP | 2006-244784 | 9/2006 |
| JP | 2007-48733 | 2/2007 |
| JP | 2007-311075 | 11/2007 |
| JP | 2008-293772 | 12/2008 |

OTHER PUBLICATIONS

International Search Report issued Apr. 28, 2009 in the International (PCT) Application No. PCT/JP2009/000838.

* cited by examiner

PLASMA DISPLAY PANEL

THIS APPLICATION IS A U.S. NATIONAL PHASE APPLICATION OF PCT INTERNATIONAL APPLICATION PCT/JP2009/000838.

TECHNICAL FIELD

The present invention relates to a plasma display panel used in a display device, and the like.

BACKGROUND ART

A plasma display panel (hereinafter, referred to as a "PDP") can be realized to incorporate a large screen and high-definition images, and as such 65-inch class televisions have been commercialized. Notably, PDPs have been implemented as high-definition televisions in which the number of scan lines is twice or more than that of a conventional NTSC method. Additionally, PDPs not containing a lead component have been demanded to address environmental concerns.

A PDP basically includes a front panel and a rear panel. The front panel includes: a glass substrate of sodium borosilicate glass produced by a float process; display electrodes each composed of a striped transparent electrode and a bus electrode formed on one principal surface of the glass substrate; a dielectric layer covering the display electrodes and functioning as a capacitor; and a protective layer made of magnesium oxide (MgO) formed on the dielectric layer. The rear panel includes: a glass substrate; striped address electrodes formed on one principal surface of the glass substrate; a base dielectric layer covering the address electrodes; barrier ribs formed on the base dielectric layer; and phosphor layers formed between the barrier ribs and that emit red, green and blue light, respectively.

The front panel and the rear panel are hermetically sealed so that the surfaces having electrodes face each other. A discharge gas of Ne—Xe is filled in a discharge space partitioned by the barrier ribs at a pressure of 400 Torr to 600 Torr. The PDP realizes a color image display by selectively applying a video signal voltage to the display electrode so as to generate electric discharge, thus exciting the phosphor layer of each color with ultraviolet rays generated by the electric discharge so as to emit red, green and blue light (see patent document 1).

In the above-described PDPs, the role of the protective layer formed on the dielectric layer of the front panel includes protecting the dielectric layer from ion bombardment due to electric discharge, emitting initial electrons so as to generate address discharge, and the like. Protecting the dielectric layer from ion bombardment is an important role for preventing a discharge voltage from increasing. Furthermore, emitting initial electrons so as to generate address discharge is an important role for preventing address discharge error that may cause a flicker of an image.

In order to reduce a flicker of an image by increasing the number of initial electrons emitted from the protective layer, an attempt to add Si and Al into MgO has been made.

Recently, higher definition televisions have been realized. As a result, high-definition (1920×1080 pixels: progressive display) PDPs having a low cost, low power consumption and high brightness have been demanded. Since electron emission performance of a protective layer determines an image quality of a PDP, it is very important to control the electron emission performance.

In PDPs, an attempt to improve the electron emission performance by mixing impurities in a protective layer has been made. However, when the electron emission performance is improved by mixing impurities in the protective layer, electric charges accumulate on the surface of the protective layer, thus increasing a damping factor, that is, reducing electric charges to be used as a memory function with the passage of time. Therefore, in order to suppress this, it is necessary to take measures, for example, to increase a voltage to be applied. Thus, a protective layer should have two conflicting properties: having a high electron emission performance; and having a high electric charge retention performance for reducing a damping factor of electric charges used as a memory function.

[Patent document 1] Japanese Patent Unexamined Publication No. 2007-48733

SUMMARY OF THE INVENTION

A PDP of the present invention includes a front panel and a rear panel. The front panel includes a substrate, a display electrode formed on the substrate, a dielectric layer formed so as to cover the display electrode, and a protective layer formed on the dielectric layer. The rear panel is disposed facing the front panel so that a discharge space is formed, the read panel including an address electrode formed in a direction intersecting the display electrode, a plurality of longitudinal barrier ribs arranged in parallel to the address electrode, and a plurality of lateral barrier ribs that are combined with the plurality of longitudinal barrier ribs to form mesh-shaped barrier ribs. The protective layer is formed by forming a base film on the dielectric layer and attaching a plurality of aggregated particles obtained by aggregating a plurality of crystal particles made of a metal oxide to the base film so as to be distributed over a surface of the base film. Furthermore, the barrier ribs are formed so that the height of the lateral barrier ribs is lower than that of the longitudinal barrier ribs.

With the above-described configuration, a PDP having an improved electron emission performance, an improved electric charge retention performance and being capable of achieving a high image quality, low cost, and low voltage can be provided. That is to say, a PDP with low electric power consumption and having high-definition and high-brightness display performance can be realized.

REFERENCE MARKS IN THE DRAWINGS

Figure 1:
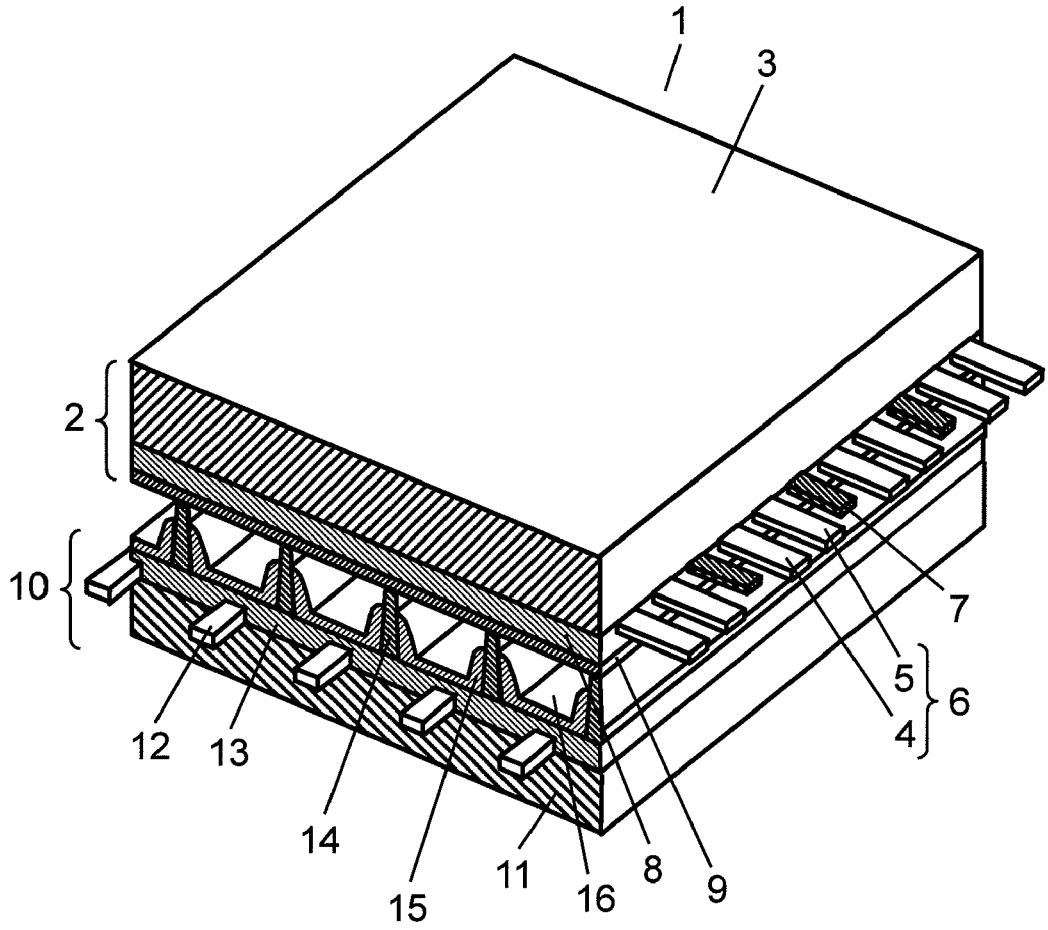
FIG. 1 is a perspective view showing a structure of a PDP in accordance with an exemplary embodiment of the present invention.

1 plasma display panel (PDP)
2 front panel
3 front glass substrate
4 scan electrode
4*a*, 5*a* transparent electrode
4*b*, 5*b* metal bus electrode
5 sustain electrode
6 display electrode
7 black stripe (light blocking layer)
8 dielectric layer
9 protective layer
10 rear panel
11 rear glass substrate
12 address electrode
13 base dielectric layer
14 barrier rib
14*a* longitudinal barrier rib
14*b* lateral barrier rib
15 phosphor layer
16 discharge space
81 first dielectric layer
82 second dielectric layer
91 base film
92 aggregated particle
92*a* crystal particles

DETAILED DESCRIPTION OF THE PREFERRED EMBODIMENT

Hereinafter, a PDP in accordance with an exemplary embodiment of the present invention is described with reference to the drawings.

Exemplary Embodiment

Figure 2:
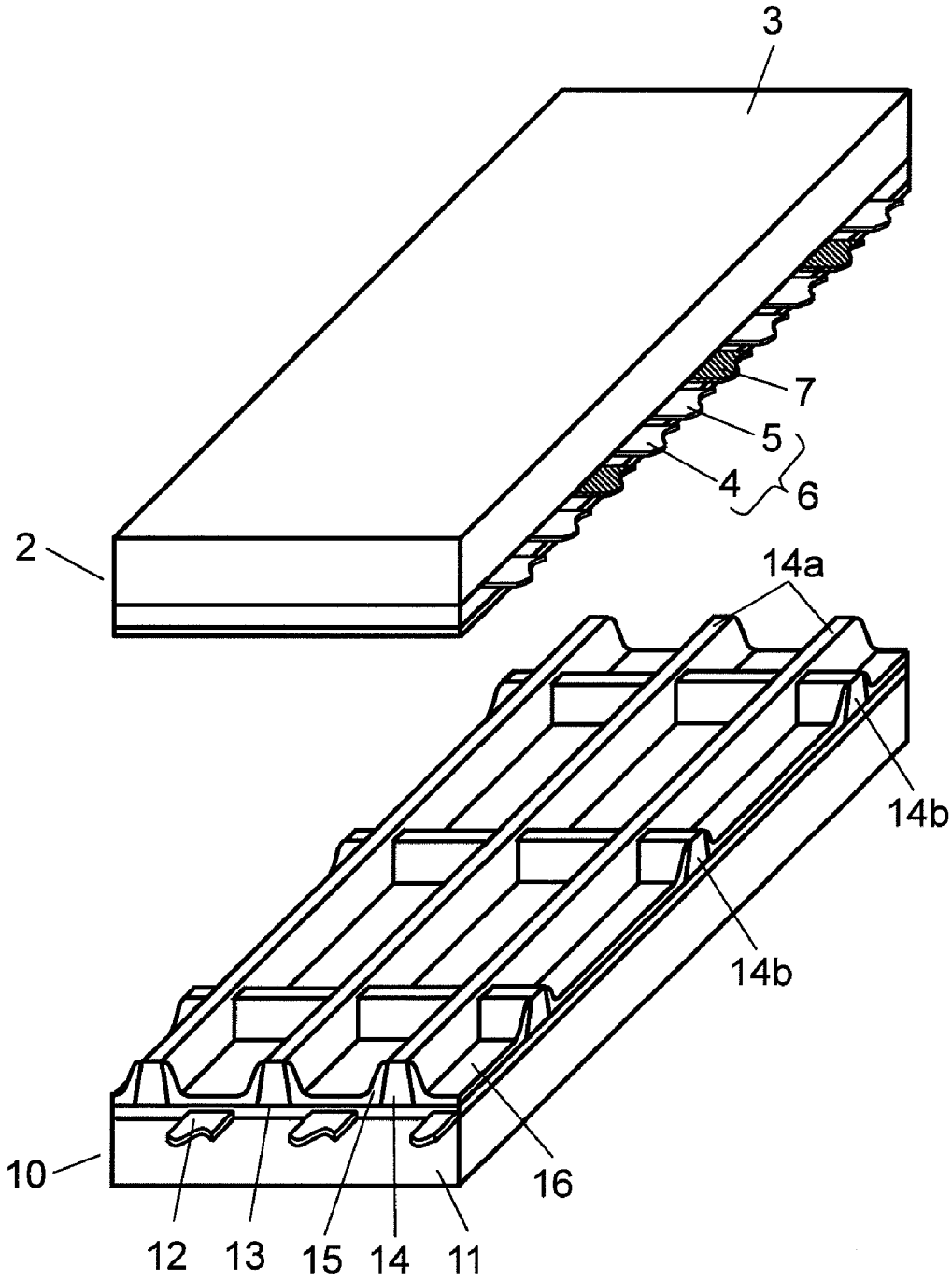
FIG. 2 is a perspective view of the PDP, which shows a front panel and a rear panel separately.
Figure 3:
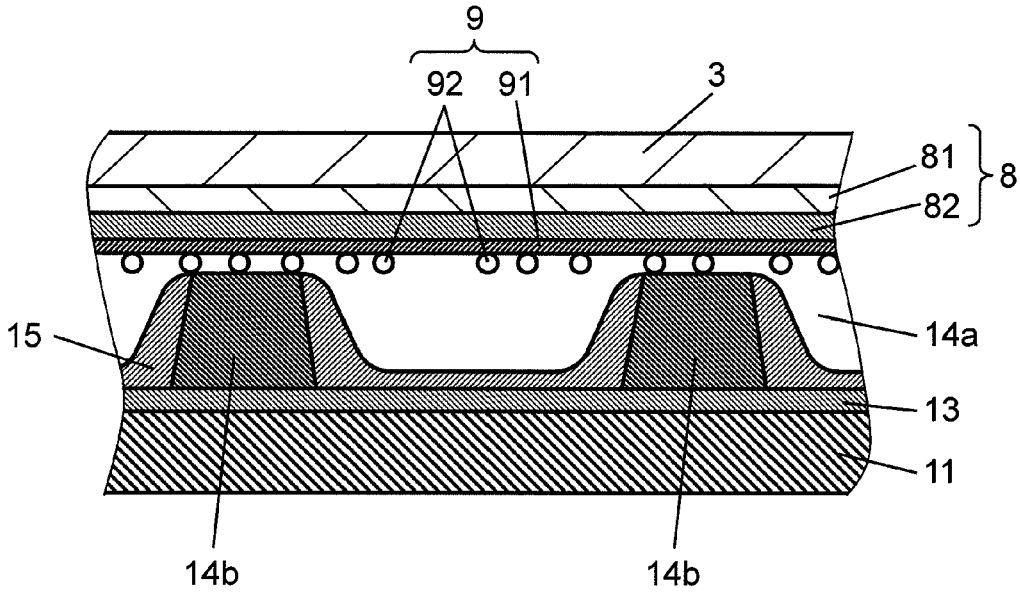
FIG. 3 is a sectional view showing a sectional structure of a discharge cell part of the PDP.

FIG. 1 is a perspective view showing a structure of a PDP in accordance with an exemplary embodiment of the present invention. FIG. 2 is a perspective view showing a front panel and a rear panel separately. FIG. 3 is a sectional view showing a sectional structure of a discharge cell part.

As shown in FIG. 1, PDP 1 includes front panel 2 including front glass substrate 3 and the like, and rear panel 10 including rear glass substrate 11 and the like. Front panel 2 and rear panel 10 are disposed facing each other. The outer peripheries of PDP 1 are hermetically sealed together with a sealing material made of, for example, a glass frit. In discharge space 16 inside the sealed PDP 1, a discharge gas such as Ne and Xe is filled at a pressure of 400 Torr to 600 Torr.

On front glass substrate 3 of front panel 2, a plurality of display electrodes 6 each composed of a pair of band-like scan electrode 4 and sustain electrode 5 and black stripes (light blocking layers) 7 are disposed in parallel to each other. On glass substrate 3, dielectric layer 8 functioning as a capacitor is formed so as to cover display electrodes 6 and blocking layers 7. Furthermore, protective layer 9 made of, for example, magnesium oxide (MgO) is formed on the surface of dielectric layer 8.

Furthermore, on rear glass substrate 11 of rear panel 10, a plurality of band-like address electrodes 12 are disposed in parallel to each other in the direction orthogonal to scan electrodes 4 and sustain electrodes 5 of front panel 2, and base dielectric layer 13 covers address electrodes 12. In addition, barrier ribs 14 with a predetermined height for partitioning discharge space 16 are formed between address electrodes 12 on base dielectric layer 13. Barrier ribs 14 include a plurality of longitudinal barrier ribs 14*a* arranged in parallel to address electrodes 12 and lateral barrier ribs 14*b* combined with longitudinal barrier ribs 14*a* to form mesh-shaped barrier ribs. Furthermore, barrier ribs 14 are formed so that the height of lateral barrier ribs 14*b* is lower than the height of longitudinal barrier ribs 14*a*.

In grooves between longitudinal barrier ribs 14*a* of barrier ribs 14, every address electrode 12, phosphor layers 15 emitting red, green and blue light by ultraviolet rays are sequentially formed by coating. Discharge cells are formed in positions in which scan electrodes 4 and sustain electrodes 5 intersect address electrodes 12. The discharge cells having red, green and blue phosphor layers 15 arranged in the direction of display electrode 6 function as pixels for color display.

As mentioned above, PDP 1 of this exemplary embodiment includes front panel 2 and rear panel 10. Front panel 2 includes a substrate, display electrode 6 formed on the substrate, dielectric layer 8 formed so as to cover display electrode 6, and protective layer 9 formed on dielectric layer 8. Rear panel 10 is disposed facing front panel 2 so that a discharge space is formed, and rear panel 10 includes address electrode 12 formed in a direction intersecting display electrode 6, a plurality of longitudinal barrier ribs 14*a* arranged in parallel to address electrode 12 and a plurality of lateral barrier ribs 14*b* combined with longitudinal barrier ribs 14*a* to form mesh-shaped barrier ribs 14. Furthermore, as shown in FIG. 3, the top portion of longitudinal barrier rib 14*a* of rear panel 10 is brought into close contact with protective film 9 of front panel 2. On the other hand, the top portion of longitudinal barrier rib 14*b* is not brought into contact with protective film 9 of front panel 2.

Figure 4:
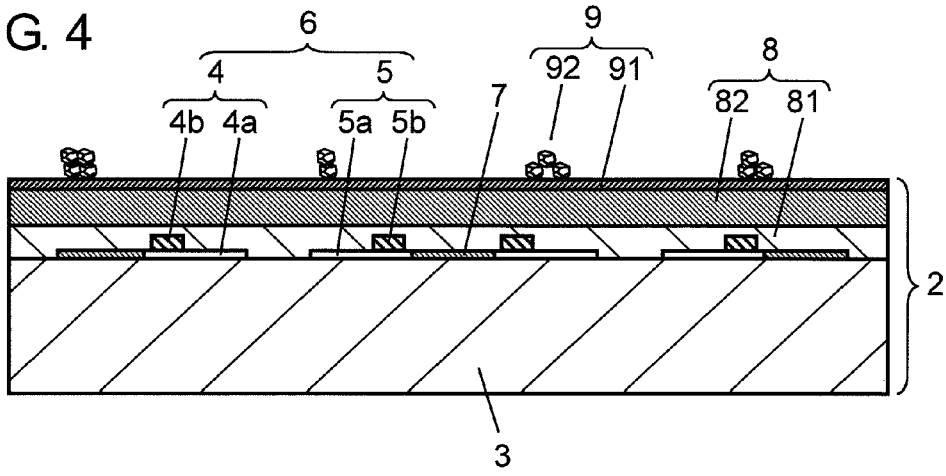
FIG. 4 is a sectional view showing a configuration of a front panel of the PDP.

FIG. 4 is a sectional view showing a configuration of front panel 2 of PDP 1 in accordance with the exemplary embodiment of the present invention. FIG. 4 is shown turned upside down with respect to FIG. 1. As shown in FIG. 4, display electrodes 6 each composed of scan electrode 4 and sustain electrode 5 and light blocking layers 7 are pattern-formed on front glass substrate 3 produced by, for example, a float method. Scan electrode 4 and sustain electrode 5 include transparent electrodes 4*a* and 5*a* made of indium tin oxide (ITO), tin oxide ($SnO_2$), or the like, and metal bus electrodes 4*b* and 5*b* formed on transparent electrodes 4*a* and 5*a*, respectively. Metal bus electrodes 4*b* and 5*b* are used for the purpose of providing the conductivity in the longitudinal direction of transparent electrodes 4*a* and 5*a* and formed of a conductive material containing a silver (Ag) material as a main component.

Dielectric layer 8 includes at least two layers, that is, first dielectric layer 81 and second dielectric layer 82. First dielectric layer 81 is provided to cover transparent electrodes 4*a* and 5*a*, metal bus electrodes 4*b* and 5*b* and light blocking layers 7 formed on front glass substrate 3. Second dielectric layer 82 is formed on first dielectric layer 81. In addition, protective layer 9 is formed on second dielectric layer 82. Protective layer 9 includes base film 91 formed on dielectric layer 8 and aggregated particles 92 attached to base film 91.

Next, a method of manufacturing a PDP is described. Firstly, scan electrodes 4, sustain electrodes 5 and light blocking layers 7 are formed on front glass substrate 3. Transparent electrodes 4*a* and 5*a* and metal bus electrodes 4*b* and 5*b* thereof are formed by patterning with the use of, for example, a photolithography method. Transparent electrodes 4*a* and 5*a* are formed by, for example, a thin film process. Metal bus electrodes 4*b* and 5*b* are formed by firing a paste containing a silver (Ag) material at a predetermined temperature to be solidified. Furthermore, light blocking layer 7 is similarly formed by a method of screen-printing a paste that contains a black pigment, or a method of forming a black pigment on the entire surface of the glass substrate, then carrying out patterning by a photolithography method, and firing thereof.

Next, a dielectric paste is coated on front glass substrate 3 by, for example, a die coating method so as to cover scan electrodes 4, sustain electrodes 5 and light blocking layer 7, thus forming a dielectric paste layer (dielectric material layer). The dielectric paste is coated and then stood still for a predetermined time, and thereby the surface of the coated dielectric paste is leveled and flattened. Thereafter, the dielectric paste layer is fired and solidified, thereby forming dielectric layer 8 that covers scan electrode 4, sustain electrode 5 and light blocking layer 7. The dielectric paste is a coating material including a dielectric material such as glass powder, a binder and a solvent.

Next, base film 91 made of magnesium oxide (MgO) is formed on dielectric layer 8 by a vacuum deposition method. In the above-mentioned steps, predetermined components, that is, scan electrode 4, sustain electrode 5, light blocking layer 7, dielectric layer 8, and base film 91 are formed on front glass substrate 3. Thus, front panel 2 is substantially completed. Formation of aggregated particle 92 for completing protective layer 9 is described later.

On the other hand, rear panel 10 is formed as follows. Firstly, a material layer as a component of address electrode 12 is formed on rear glass substrate 11 by, for example, a method of screen-printing a paste containing a silver (Ag) material, or a method of forming a metal film on the entire surface and then patterning it by a photolithography method. Then, the material layer is fired at a predetermined temperature. Thus, address electrode 12 is formed.

Next, on rear glass substrate 11 on which address electrode 12 is formed, a dielectric paste is coated so as to cover address electrodes 12 by, for example, a die coating method. Thus, a dielectric paste layer is formed. Then, by firing the dielectric paste layer, base dielectric layer 13 is formed. Note here that the dielectric paste is a coating material including a dielectric material such as glass powder, a binder, and a solvent.

Next, by coating a barrier rib formation paste containing a material for the barrier rib on base dielectric layer 13 and patterning it into a predetermined shape, a barrier rib material layer is formed. Then, the barrier rib material layer is fired so as to form barrier ribs 14. Herein, barrier ribs 14 are formed so that the height of lateral barrier ribs 14*b* is lower than the height of longitudinal barrier ribs 14*a* by, for example, 10 μm to 20 μm. Herein, a method of patterning the barrier rib formation paste coated on base dielectric layer 13 may include a photolithography method and a sand-blast method. Next, a phosphor paste containing a phosphor material is coated on base dielectric layer 13 between neighboring barrier ribs 14 and on the side surfaces of barrier ribs 14 and fired. Thereby, phosphor layer 15 is formed. With the above-mentioned steps, rear panel 10 including rear glass substrate 11 having predetermined component members thereon is completed. As mentioned above, since barrier ribs 14 are formed so that the height of lateral barrier ribs 14*b* is lower than the height of longitudinal barrier ribs 14*a*, a phosphor paste can be coated easily. Furthermore, since lateral barrier ribs 14*b* exist, the effective area in which the phosphor paste is coated is increased. Consequently, the brightness of the PDP can be increased.

Front panel 2 and rear panel 10, which include predetermined component members in this way, are disposed facing each other so that scan electrodes 4 and address electrodes 12 are disposed orthogonal to each other, and sealed together at the peripheries thereof with a glass frit. A discharge gas including, for example, Ne and Xe, is filled in discharge space 16. Thus, PDP 1 is completed.

Herein, first dielectric layer 81 and second dielectric layer 82 forming dielectric layer 8 of front panel 2 are described in detail. A dielectric material of first dielectric layer 81 includes the following material compositions: 20 wt. % to 40 wt. % of bismuth oxide ($Bi_2O_3$); 0.5 wt. % to 12 wt. % of at least one selected from calcium oxide (CaO), strontium oxide (SrO) and barium oxide (BaO); and 0.1 wt. % to 7 wt. % of at least one selected from molybdenum oxide ($MoO_3$), tungsten oxide ($WO_3$), cerium oxide ($CeO_2$), and manganese oxide ($MnO_2$).

Instead of molybdenum oxide ($MoO_3$), tungsten oxide ($WO_3$), cerium oxide ($CeO_2$) and manganese oxide ($MnO_2$), 0.1 wt. % to 7 wt. % of at least one selected from copper oxide (CuO), chromium oxide ($Cr_2O_3$), cobalt oxide ($CO_2O_3$), vanadium oxide ($V_2O_7$) and antimony oxide ($Sb_2O_3$) may be included.

Furthermore, as components other than the above-mentioned components, material compositions that do not include a lead component, for example, 0 wt. % to 40 wt. % of zinc oxide (ZnO), 0 wt. % to 35 wt. % of boron oxide ($B_2O_3$), 0 wt. % to 15 wt. % of silicon oxide ($SiO_2$) and 0 wt. % to 10 wt. % of aluminum oxide ($Al_2O_3$) may be included. The contents of these material compositions are not particularly limited.

The dielectric materials including these composition components are ground to an average particle diameter of 0.5 μm to 2.5 μm by using a wet jet mill or a ball mill to form dielectric material powder. Then, 55 wt % to 70 wt % of the dielectric material powders and 30 wt % to 45 wt % of binder components are well kneaded by using a three-roller to form a paste for the first dielectric layer to be used in die coating or printing.

The binder component is ethyl cellulose, or terpineol containing 1 wt % to 20 wt % of acrylic resin, or butyl carbitol acetate. Furthermore, in the paste, if necessary, at least one or more of dioctyl phthalate, dibutyl phthalate, triphenyl phosphate and tributyl phosphate may be added as a plasticizer; and at least one or more of glycerol monooleate, sorbitan sesquioleate, Homogenol (Kao Corporation), and an alkylallyl phosphate may be added as a dispersing agent, so that the printing property may be improved.

Next, this first dielectric layer paste is printed on front glass substrate 3 by a die coating method or a screen printing method so as to cover display electrodes 6 and dried, followed by firing at a temperature of 575° C. to 590° C., that is, a slightly higher temperature than the softening point of the dielectric material.

Next, second dielectric layer 82 is described. A dielectric material of second dielectric layer 82 includes 11 wt. % to 20 wt. % of bismuth oxide ($Bi_2O_3$), and further includes 1.6 wt. % to 21 wt. % of at least one selected from calcium oxide (CaO), strontium oxide (SrO), and barium oxide (BaO), and 0.1 wt. % to 7 wt. % of at least one selected from molybdenum oxide ($MoO_3$), tungsten oxide ($WO_3$), and cerium oxide ($CeO_2$).

Instead of molybdenum oxide ($MoO_3$), tungsten oxide ($WO_3$) and cerium oxide ($CeO_2$), 0.1 wt. % to 7 wt. % of at least one selected from copper oxide (CuO), chromium oxide ($Cr_2O_3$), cobalt oxide ($Co_2O_3$), vanadium oxide ($V_2O_7$), antimony oxide ($Sb_2O_3$) and manganese oxide ($MnO_2$) may be included.

Furthermore, as components other than the above-mentioned components, material compositions that do not include a lead component, for example, 0 wt. % to 40 wt. % of zinc oxide (ZnO), 0 wt. % to 35 wt. % of boron oxide ($B_2O_3$), 0 wt. % to 15 wt. % of silicon oxide ($SiO_2$) and 0 wt. % to 10 wt. % of aluminum oxide ($Al_2O_3$) may be included. The contents of these material compositions are not particularly limited.

The dielectric materials including these composition components are ground to an average particle diameter of 0.5 μm to 2.5 μm by using a wet jet mill or a ball mill to form dielectric material powder. Then, 55 wt % to 70 wt % of the dielectric material powders and 30 wt % to 45 wt % of binder components are well kneaded by using a three-roller to form a paste for the second dielectric layer to be used in die coating or printing. The binder component is ethyl cellulose, or terpineol containing 1 wt % to 20 wt % of acrylic resin, or butyl carbitol acetate. Furthermore, in the paste, if necessary, dioctyl phthalate, dibutyl phthalate, triphenyl phosphate and tributyl phosphate may be added as a plasticizer; and glycerol monooleate, sorbitan sesquioleate, Homogenol (Kao Corporation), an alkylallyl phosphate, and the like, may be added as a dispersing agent so that the printing property may be improved.

Next, this second dielectric layer paste is printed on first dielectric layer 81 by a screen printing method or a die coating method and dried, followed by firing at a temperature of 550° C. to 590° C., that is, a slightly higher temperature than the softening point of the dielectric material.

Note here that it is preferable that the film thickness of dielectric layer 8 in total of first dielectric layer 81 and second dielectric layer 82 is not more than 41 μm in order to secure the visible light transmittance. In first dielectric layer 81, in order to suppress the reaction between metal bus electrodes 4*b* and 5*b* and silver (Ag), the content of bismuth oxide ($Bi_2O_3$) is set to be 20 wt % to 40 wt %, which is higher than the content of bismuth oxide in second dielectric layer 82. Therefore, since the visible light transmittance of first dielectric layer 81 becomes lower than that of second dielectric layer 82, the film thickness of first dielectric layer 81 is set to be thinner than that of second dielectric layer 82.

In second dielectric layer 82, it is not preferable that the content of bismuth oxide ($Bi_2O_3$) is not more than 11 wt % because bubbles tend to be generated in second dielectric layer 82 although coloring does not easily occur. Furthermore, it is not preferable that the content is more than 40 wt % for the purpose of increasing the transmittance because coloring tends to occur.

As the film thickness of dielectric layer 8 is smaller, the effect of improving the panel brightness and reducing the discharge voltage is more remarkable. Therefore, it is desirable that the film thickness is set to be as small as possible within a range in which a withstand voltage is not lowered. From such a viewpoint, in the exemplary embodiment of the present invention, the film thickness of dielectric layer 8 is set to be not more than 41 μm, that of first dielectric layer 81 is set to be 5 μm to 15 μm, and that of second dielectric layer 82 is set to be 20 μm to 36 μm.

In the thus manufactured PDP, even when a silver (Ag) material is used for display electrode 6, a coloring phenomenon (yellowing) in front glass substrate 3 is suppressed and bubbles are not generated in dielectric layer 8. Therefore, dielectric layer 8 having excellent withstand voltage performance can be realized.

Next, in the PDP in accordance with the exemplary embodiment of the present invention, the reason why these dielectric materials suppress the generation of yellowing or bubbles in first dielectric layer 81 is considered. It is known that by adding molybdenum oxide ($MoO_3$) or tungsten oxide ($WO_3$) to dielectric glass containing bismuth oxide ($Bi_2O_3$), compounds such as $Ag_2MoO_4$, $Ag_2Mo_2O_7$, $Ag_2Mo_4O_{13}$, $Ag_2WO_4$, $Ag_2W_2O_7$, and $Ag_2W_4O_{13}$ are easily generated at such a low temperature as not higher than 580° C. In this exemplary embodiment of the present invention, since the firing temperature of dielectric layer 8 is 550° C. to 590° C., silver ions ($Ag^+$) dispersing in dielectric layer 8 during firing react with molybdenum oxide ($MoO_3$), tungsten oxide ($WO_3$), cerium oxide ($CeO_2$), and manganese oxide ($MnO_2$) in dielectric layer 8 so as to generate a stable compound and are stabilized. That is to say, since silver ions ($Ag^+$) are stabilized without undergoing reduction, they do not aggregate to form a colloid. Consequently, silver ions ($Ag^+$) are stabilized, thereby reducing the generation of oxygen accompanying the colloid formation of silver (Ag). Thus, the generation of bubbles in dielectric layer 8 is reduced.

On the other hand, in order to make these effects be effective, it is preferable that the content of molybdenum oxide ($MoO_3$), tungsten oxide ($WO_3$), cerium oxide ($CeO_2$), and manganese oxide ($MnO_2$) in the dielectric glass containing bismuth oxide ($Bi_2O_3$) is not less than 0.1 wt. %. It is more preferable that the content is not less than 0.1 wt. % and not more than 7 wt. %. In particular, it is not preferable that the content is less than 0.1 wt. % because the effect of suppressing yellowing is reduced. Furthermore, it is not preferable that the content is more than 7 wt. % because coloring occurs in the glass.

That is to say, in dielectric layer 8 of the PDP in accordance with the exemplary embodiment of the present invention, the generation of yellowing phenomenon and bubbles is suppressed in first dielectric layer 81 that is in contact with metal bus electrodes 4*b* and 5*b* made of a silver (Ag) material. Furthermore, in dielectric layer 8, high light transmittance is realized by second dielectric layer 82 formed on first dielectric layer 81. As a result, it is possible to realize a PDP in which generation of bubbles and yellowing is extremely small and transmittance is high in dielectric layer 8 as a whole.

Next, as the feature of the PDP in accordance with the exemplary embodiment of the present invention, a configuration and a manufacturing method of a protective layer are described.

Figure 5:
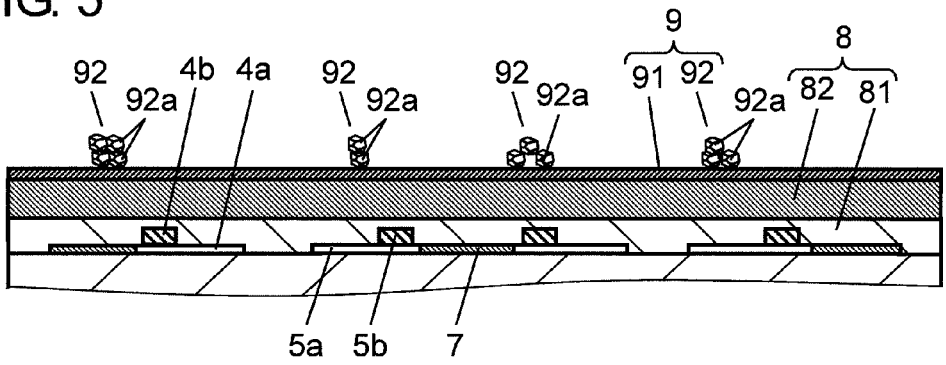
FIG. 5 is an enlarged sectional view showing a protective layer part of the PDP.

FIG. 5 is an enlarged sectional view showing a protective layer part of a PDP in accordance with this exemplary embodiment of the present invention. The PDP in accordance with this exemplary embodiment includes protective layer 9 as shown in FIG. 5. Protective layer 9 includes base film 91 made of MgO containing Al as an impurity on dielectric layer 8. Then, aggregated particles 92 obtained by aggregating a plurality of crystal particles 92*a* of MgO as metal oxide are discretely scattered on base film 91. Thus, a plurality of aggregated particles 92 are attached to base film 91 so as to be distributed over the entire surface of base film 91 in a substantially uniform manner, thereby forming protective layer 9. Note here that protective layer 9 on dielectric layer 8 may be formed by forming base film 91 on second dielectric layer 82 and attaching a plurality of crystal particles made of metal oxide base film 91 so that they are distributed over the entire surface of base film 91.

Figure 6:
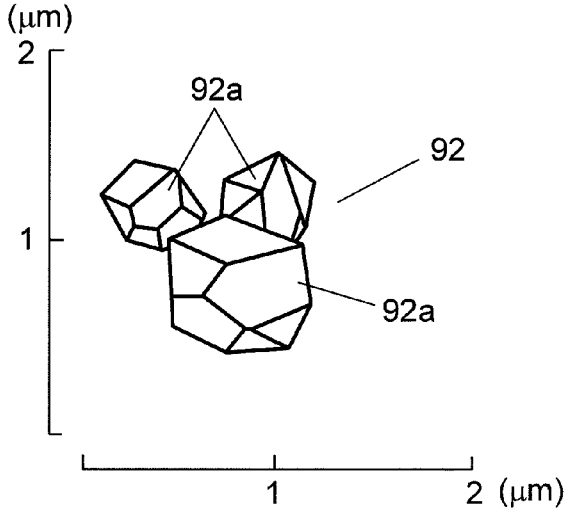
FIG. 6 is an enlarged view illustrating an aggregated particle in the protective layer of the PDP.

Herein, aggregated particle 92 is in a state in which crystal particles 92*a*, having a predetermined primary particle diameter, are aggregated or necked as shown in FIG. 6. In aggregated particle 92, a plurality of primary particles are not combined as a solid form with a large bonding strength but they are combined as an assembly structure by static electricity, Van der Waals force, or the like. That is to say, crystal particles 92*a* are combined by an external stimulation such as an ultrasonic wave to such a degree that a part or all of crystal particles 92*a* are in a state of primary particles. It is desirable that the particle diameter of aggregated particles 92 is about 1 μm and that crystal particle 92*a* has a shape of a polyhedron having seven faces or more, for example, a truncated octahedron and a dodecahedron.

Furthermore, the primary particle diameter of crystal particle 92*a* of MgO can be controlled by the production condition of crystal particle 92*a*. For example, when crystal particle 92*a* of MgO is produced by firing an MgO precursor such as magnesium carbonate or magnesium hydroxide, the particle diameter can be controlled by controlling the firing temperature or firing atmosphere. In general, the firing temperature can be selected in the range from about 700° C. to about 1500° C. When the firing temperature is set to be a relatively high temperature such as not less than 1000° C., the primary particle diameter can be controlled to be about 0.3 to 2 μm. Furthermore, when crystal particle 92*a* is obtained by heating an MgO precursor, it is possible to obtain aggregated particles 92 in which a plurality of primary particles are combined by aggregation or a phenomenon called necking during production process.

Next, results of experiments carried out for confirming the effect of the PDP including the protective layer in accordance with the exemplary embodiment of the present invention are described.

Figure 7:
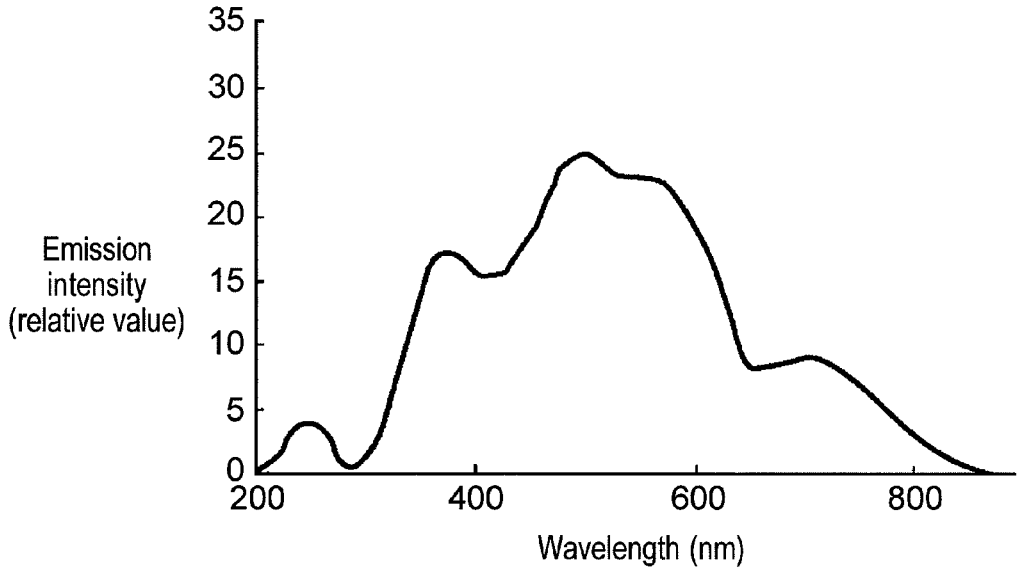
FIG. 7 is a graph showing a measurement result of cathode luminescence of a crystal particle.

Firstly, PDPs including protective layers having different configurations are made as trial products. Trial product 1 is a PDP including only a protective layer made of MgO. Trial product 2 is a PDP including a protective layer made of MgO doped with impurities such as Al and Si. Trial product 3 is a PDP in which only primary particles of crystal particles of metal oxide are scattered and attached to a base film made of MgO. Trial product 4 is a product of the present invention and is a PDP in which aggregated particles obtained by aggregating a plurality of crystal particles are attached to the base film made of MgO so as to be distributed over the entire surface of the base film substantially uniformly as mentioned above. In trial products 3 and 4, as the metal oxide, single-crystal particles of MgO are used. Furthermore, in trial product 4 in accordance with the exemplary embodiment of the present invention, when a cathode luminescence of the crystal particles attached to the base film is measured, trial product 4 has a property of emission intensity with respect to wavelength shown in FIG. 7. The emission intensity is represented by relative values.

PDPs having these four kinds of configurations of protective layers are examined for the electron emission performance and the electric charge retention performance.

As the electron emission performance is represented by a larger value, the amount of electron emission is lager. The electron emission performance is represented by the initial electron emission amount determined by the surface states by discharge, kinds and states of gases. The initial electron emission amount can be measured by a method of measuring the amount of electron current emitted from a surface after the surface is irradiated with ions or electron beams. However, it is difficult to evaluate the front panel surface in a nondestructive way. Therefore, as described in Japanese Patent Unexamined Publication No. 2007-48733, the value called a statistical lag time among lag times at the time of discharge, which is an index showing the discharging tendency, is measured. By integrating the inverse number of the value, a numeric value linearly corresponding to the initial electron emission amount can be calculated. Herein, the thus calculated value is used to evaluate the initial electron emission amount. This lag time at the time of discharge means a time of discharge delay in which discharge is delayed from the rising time of the pulse. The main factor of this discharge delay is thought to be that the initial electron functioning as a trigger is not easily emitted from a protective layer surface toward discharge space at the time when discharge is started.

Furthermore, the electric charge retention performance is represented by using, as its index, a value of a voltage applied to a scan electrode (hereinafter, referred to as "Vscn lighting voltage") necessary to suppress the phenomenon of releasing electric charge when a PDP is produced. That is to say, it is shown that the lower the Vscn lighting voltage is, the higher the electric charge retention performance is. This is advantageous in designing of a panel of a PDP because driving at a low voltage is possible. That is to say, as a power supply or electrical components of a PDP, components having a withstand voltage and a small capacity can be used. In current products, as semiconductor switching elements such as MOSFET for applying a scanning voltage to a panel sequentially, an element having a withstand voltage of about 150 V is used. Therefore, it is desirable that the Vscn lighting voltage is reduced to not more than 120 V with considering the fluctuation due to temperatures.

Figure 8:
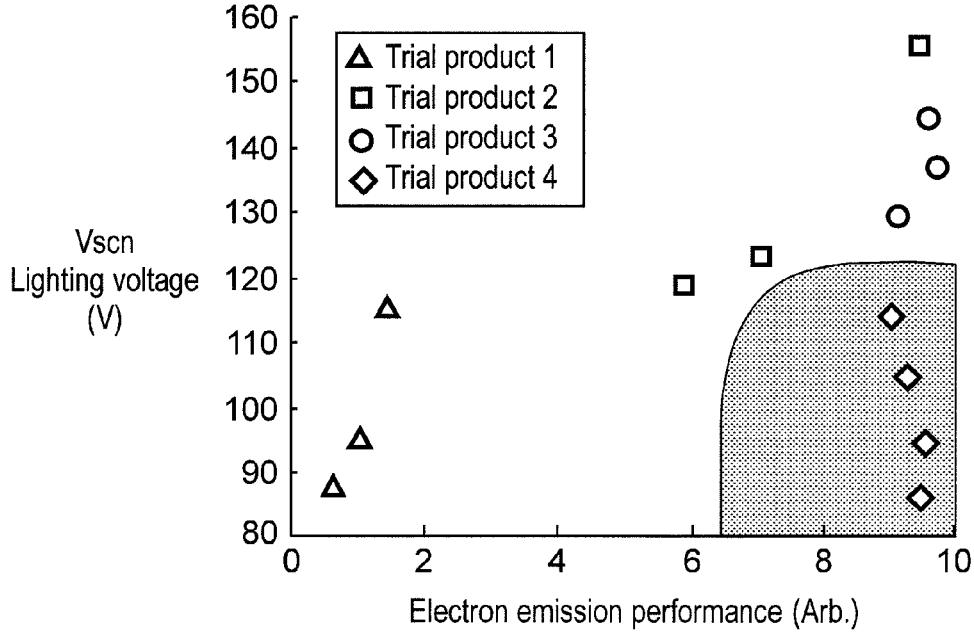
FIG. 8 is a graph showing an examination result of electron emission performance and a Vscn lighting voltage in a PDP in a result of an experiment carried out to illustrate the effect by an exemplary embodiment of the present invention.

Results of examination of the electron emission performance and the electric charge retention performance are shown in FIG. 8. As is apparent from FIG. 8, trial product 4 can achieve excellent performance: the Vscn lighting voltage can be not more than 120 V in the evaluation of the electric charge retention performance, and the electron emission performance is not less than 6.

In general, the electron emission performance and the electric charge retention performance of a protective layer of a PDP conflict with each other. The electron emission performance can be improved, for example, by changing the film formation condition of the protective layer or by forming a film by doping the protective layer with impurities such as Al, Si, and Ba. However, the Vscn lighting voltage is also increased as a side effect.

In a PDP including a protective layer in accordance with the exemplary embodiment of the present invention, the electron emission performance of not less than 6 and the Vscn lighting voltage as the electric charge retention performance of not more than 120 V can be achieved. Consequently, in a protective layer of a PDP in which the number of scan lines tends to increase and the cell size tends to be smaller according to high definition, both the electron emission performance and the electric charge retention performance can be satisfied.

Next, the particle diameter of crystal particle used in the protective layer of the PDP in accordance with the exemplary embodiment of the present invention is described. In the description below, the particle diameter denotes an average particle diameter, i.e., a volume cumulative mean diameter (D50).

Figure 9:
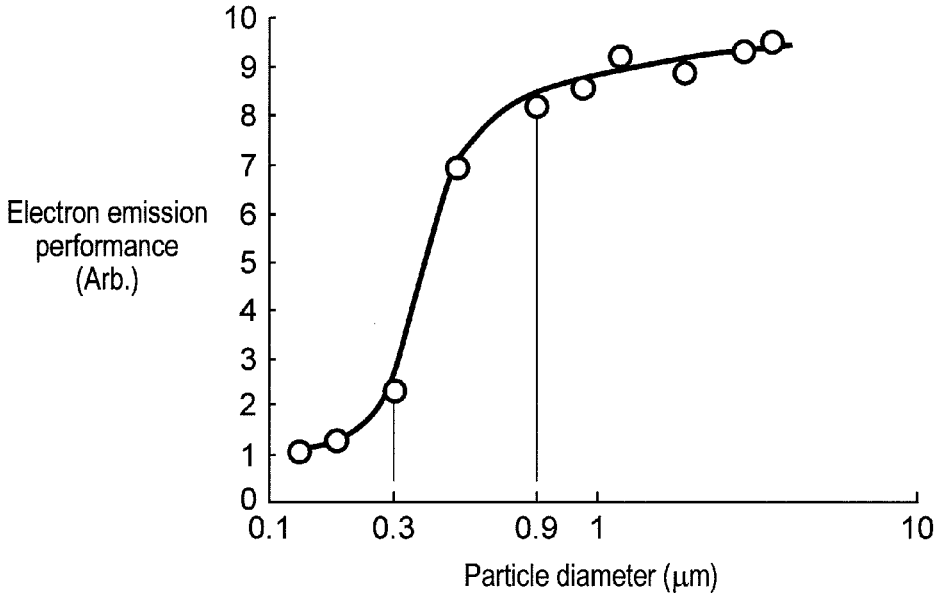
FIG. 9 is a graph showing a relation between a particle diameter of a crystal particle and electron emission performance.

FIG. 9 shows a result of an experiment for examining the electron emission performance by changing the particle diameter of MgO crystal particle in trial product 4 in accordance with the exemplary embodiment described with reference to FIG. 8 above. In FIG. 9, the particle diameter of MgO crystal particle is measured by SEM observation of crystal particles.

FIG. 9 shows that when the particle diameter is as small as about 0.3 μm, the electron emission performance is reduced, and that when the particle diameter is substantially not less than 0.9 μm, high electron emission performance can be obtained.

In order to increase the number of emitted electrons in the discharge cell, it is desirable that the number of crystal particles per unit area on the base film is large. According to the experiment carried out by the present inventors, when crystal particles exist in a portion corresponding to the top portion of barrier rib 14 of the rear panel that is in close contact with the protective film of the front panel, the top portion of barrier rib 14 may be damaged. As a result, it is shown that the material may be put on a phosphor, causing a phenomenon that the corresponding cell is not normally lighted. The phenomenon that the barrier rib is damaged does not easily occur if crystal particles do not exist on a portion corresponding to the top portion of barrier rib 14. Therefore, as the number of crystal particles to be attached increases, the rate of occurrence of the damage of the barrier rib increases.

As mentioned above, in the PDP in accordance with this exemplary embodiment, the height of lateral barrier ribs 14*b* is lower than the height of longitudinal barrier ribs 14*a*. Therefore, only the top portion of longitudinal barrier rib 14*a* is brought into close contact with the protective film of the front panel. The top portion of the lateral barrier rib 14*b* is not brought into contact with the protective film. Therefore, it is desirable that the rate of occurrence of the damage of the barrier rib is reduced as compared with the case where the height of the longitudinal barrier rib and that of the lateral barrier rib are equal to each other.

Figure 10:
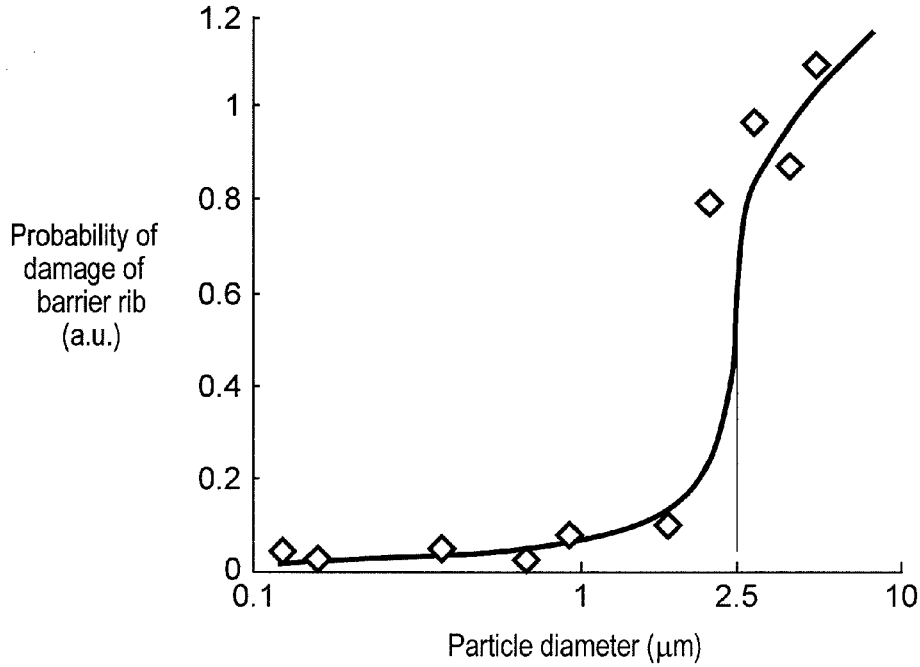
FIG. 10 is a graph showing a relation between a particle diameter of a crystal particle and the occurrence rate of damage of a barrier rib.

FIG. 10 is a graph showing a result of an experiment for examining a relation between the particle diameter and the damage of the barrier rib when the same number of crystal particles having different particle diameters are scattered in a unit area in trial product 4 in accordance with the exemplary embodiment described with reference to FIG. 8 above.

As is apparent from FIG. 10, when the crystal particle diameter is as large as about 2.5 μm, the probability of damage of the barrier rib rapidly increases. However, when the crystal particle diameter is less than 2.5 μm, the probability of damage of the barrier rib can be reduced to relatively small.

Based on the above-mentioned results, it is thought to be desirable that crystal particles have a particle diameter of not less than 0.9 μm and not more than 2.5 μm in the protective layer of the PDP in accordance with the exemplary embodiment. However, in actual mass production of PDPs, variation of crystal particles in manufacturing or variation in manufacturing a protective layer needs to be considered.

Figure 11:
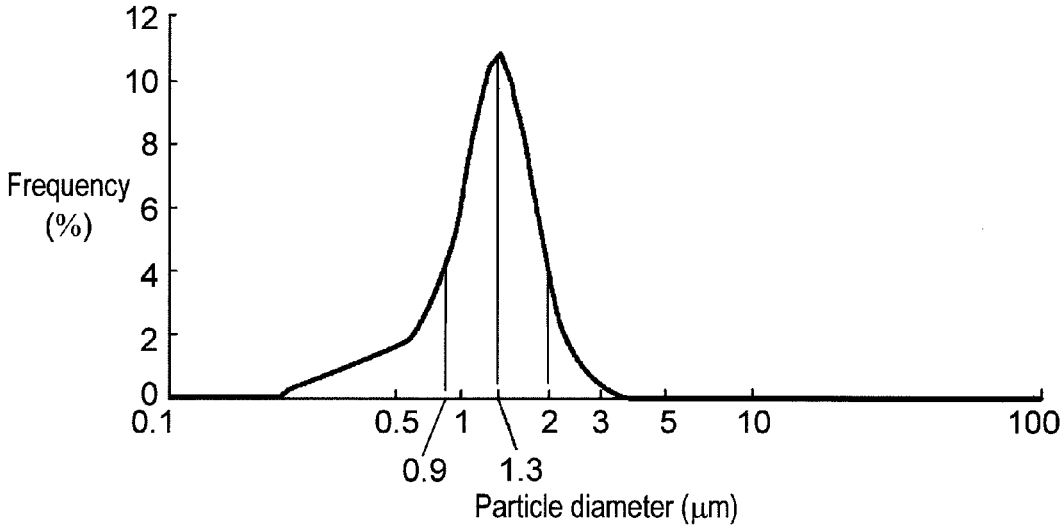
FIG. 11 is a graph showing an example of particle size distribution of aggregated particles in a PDP in accordance with an exemplary embodiment of the present invention.

In order to consider the factors of variation in manufacturing and the like, an experiment using crystal particles having different particle size distributions is carried out. FIG. 11 is a graph showing one example of the particle size distribution of the aggregated particles in the PDP in accordance with the exemplary embodiment of the present invention. The frequency (%) in the ordinate shows a rate (%) of the amount of aggregated particles existing in each of divided ranges of particle diameters shown in the abscissas with respect to the total amount of aggregated particles. As a result of the experiment, as shown in FIG. 11, it is found that when aggregated particles having the average particle diameter of not less than 0.9 μm and not more than 2 μm are used, the above-mentioned effect of the invention can be obtained stably.

As mentioned above, in the PDP including the protective layer in accordance with the exemplary embodiment of the present invention, the electron emission performance of not less than 6 and the Vscn lighting voltage as the electric charge retention performance of not more than 120 V can be achieved. That is to say, in a protective layer of a PDP in which the number of scanning lines tends to increase and the cell size tends to be smaller according to the high definition, both the electron emission performance and the electric charge retention performance can be satisfied. Thus, a PDP having a high-definition and a high-brightness display performance, and also having a low electric power consumption can be realized.

Next, manufacturing steps of forming a protective layer in a PDP in accordance with the exemplary embodiment are described with reference to FIG. 12.

Figure 12:
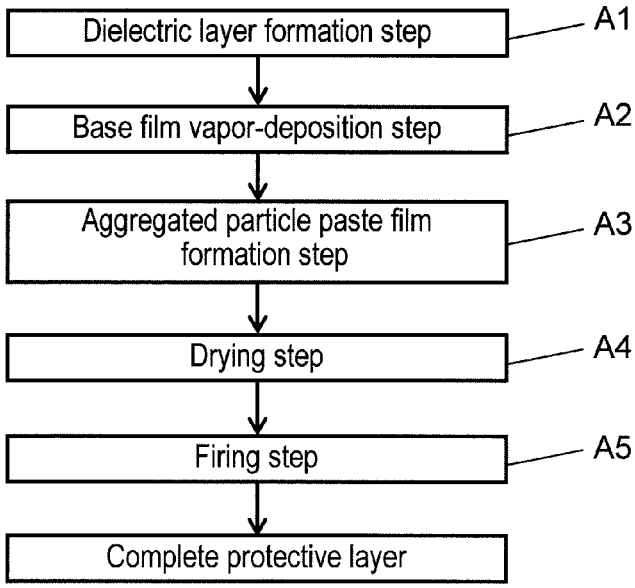
FIG. 12 is a process flow chart showing the steps of forming a protective layer in a method of manufacturing a PDP in accordance with an exemplary embodiment of the present invention.

As shown in FIG. 12, dielectric layer formation step A1 of forming dielectric layer 8 including a laminated structure composed of first dielectric layer 81 and second dielectric layer 82 is carried out. Then, in the following base film vapor-deposition step A2, a base film made of MgO is formed on second dielectric layer 82 of dielectric layer 8 by a vacuum-vapor-deposition method using a sintered body of MgO containing aluminum (Al) as a raw material.

Then, aggregated particle paste film formation step A3 of discretely attaching a plurality of aggregated particles to a non-fired base film formed in base film vapor-deposition step A2 is carried out.

In step A3, firstly, an aggregated particle paste obtained by mixing aggregated particles 92 having a predetermined particle size distribution together with a resin component into a solvent is prepared. The aggregated particle paste is coated on the non-fired base film by a printing method such as a screen printing method so as to form an aggregated particle paste film. An example of methods of coating the aggregated particle paste on the not-fired base film so as to form an aggregated particle paste film may include a spray method, a spin-coating method, a die coating method, a slit coating method, and the like, in addition to the screen printing method.

After the aggregated particle paste film is formed, drying step A4 of drying the aggregated particle paste film is carried out.

Thereafter, the non-fired base film formed in base film vapor-deposition step A2 and the aggregated particle paste film formed in aggregated particle paste film formation step A3 and subjected to drying step A4 are fired simultaneously at a temperature of several hundred degrees in firing step A5. In firing step A5, the solvent and resin components remaining in the aggregated particle paste film are removed, so that protective layer 9 in which aggregated particles 92 obtained by aggregating a plurality of metal oxide crystal particles 92*a* are attached to base film 91 can be formed.

With this method, a plurality of aggregated particles 92 can be attached to base film 91 so as to be distributed over the entire surface in a substantially uniform manner.

In addition to such a method, a method of directly spraying a particle group together with gas without using a solvent or a scattering method by simply using gravity may be used.

In the above description, as a protective layer, MgO is used as an example. However, a performance required by the base is high sputter resistance performance for protecting a dielectric layer from ion bombardment and an electron emission performance may not be so high. In most of conventional PDPs, a protective layer containing MgO as a main component is formed in order to obtain predetermined level or more of electron emission performance and sputter resistance performance. However, for achieving a configuration in which the electron emission performance is mainly controlled by metal oxide single-crystal particles, MgO is not necessarily used. Other materials such as $Al_2O_3$ having an excellent shock resistance property may be used.

In this Example, MgO particles are used as single-crystal particles, but the other single-crystal particles may be used. The same effect can be obtained when other single-crystal particles of oxide of metal such as Sr, Ca, Ba, and Al having high electron emission performance similar to MgO are used. Therefore, the kind of particle is not limited to MgO.

INDUSTRIAL APPLICABILITY

As mentioned above, the present invention is useful in realizing a PDP having a high-definition and a high-brightness display performance and a low electric power consumption.

The invention claimed is:

1. A plasma display panel comprising:

a front panel including:

a substrate;

a display electrode formed on the substrate;

a dielectric layer formed so as to cover the display electrode; and a protective layer formed on the dielectric layer; and a rear panel being disposed facing the front panel so that a discharge space is formed, the rear panel including an address electrode formed in a direction intersecting the display electrode, a plurality of longitudinal barrier ribs arranged in parallel to the address electrode, and a plurality of lateral barrier ribs combined with the longitudinal barrier ribs to form mesh-shaped barrier ribs, wherein the protective layer is formed by forming a base film on the dielectric layer and attaching a plurality of aggregated particles obtained by aggregating a plurality of crystal particles made of a metal oxide to the base film so as to be discretely distributed over a surface of the base film, and wherein the longitudinal barrier ribs and the lateral barrier ribs are formed so that a height of the lateral barrier ribs is lower than a height of the longitudinal barrier ribs.

2. The plasma display panel of claim 1, wherein an average particle diameter of each of the plurality of crystal particles is not less than 0.9 μm and not more than 2 μm.

3. The plasma display panel of claim 1, wherein the base film is made of MgO.

* * * * *